US005087051A

United States Patent [19]

LoBue

[11] Patent Number: 5,087,051

[45] Date of Patent: Feb. 11, 1992

[54] QUIZ FOOTBALL BOARD GAME

[76] Inventor: Salvatore LoBue, 879 Bohemia Pky., Bohemia, N.Y. 11716

[21] Appl. No.: 718,799

[22] Filed: Jun. 21, 1991

[51] Int. Cl.[5] ..... A63F 3/00; A63F 9/18

[52] U.S. Cl. ..... 273/247; 273/431

[58] Field of Search ..... 273/244–247, 273/243, 249, 94 R, 429–432

[56] References Cited

U.S. PATENT DOCUMENTS

| | | | |
|---|---|---|---|
| 4,000,897 | 1/1977 | York | 273/244 |
| 4,465,282 | 8/1984 | Dillon | 273/247 |
| 4,856,780 | 8/1989 | Begley | 273/244 |

FOREIGN PATENT DOCUMENTS

| | | | |
|---|---|---|---|
| 2573666 | 5/1986 | France | 273/244 |
| 2220147 | 1/1990 | United Kingdom | 273/245 |

OTHER PUBLICATIONS

Book of 1000 Family Games by Reader's Digest, 1971 "Blackboard Football", p. 102.

*Primary Examiner*—Benjamin Layno
*Attorney, Agent, or Firm*—Michael I. Kroll

[57] ABSTRACT

A quiz football board game is provided which consists of a game board having a continuous path around its perimeter divided into consecutive playing spaces bearing instructions representing various things to do during the play of the game and a plurality of simulated football playing fields with yardage markings thereon. A playing piece is for each of the game players with each playing piece representing a football team and being of a size to fit within the playing spaces. A change mechanism is openable by the players in sequence for determining the number of playing spaces to be traversed per turn by each playing piece. A football marker is for indicating the position and advancement of a football along one of the simulated football playing fields. A down marker is to indicate the correct down for each player. A plurality of professional football question and answer cards, a plurality of college football question and answer cards, a plurality of offensive penalty cards and a plurality of defensive penalty cards are also provided.

12 Claims, 3 Drawing Sheets

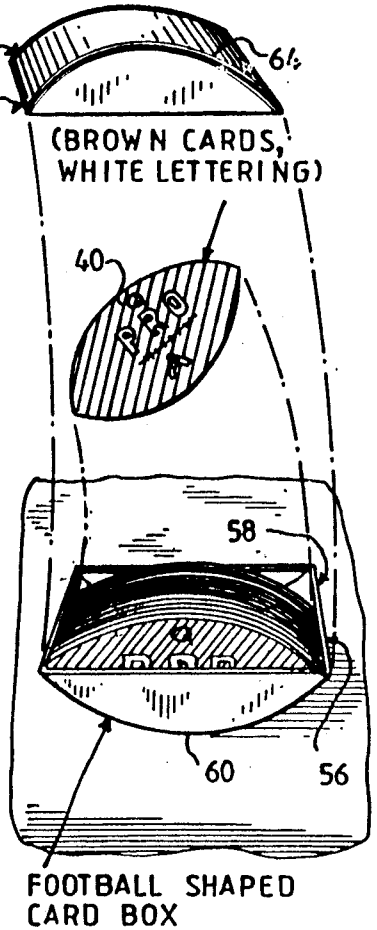
Fig. 5
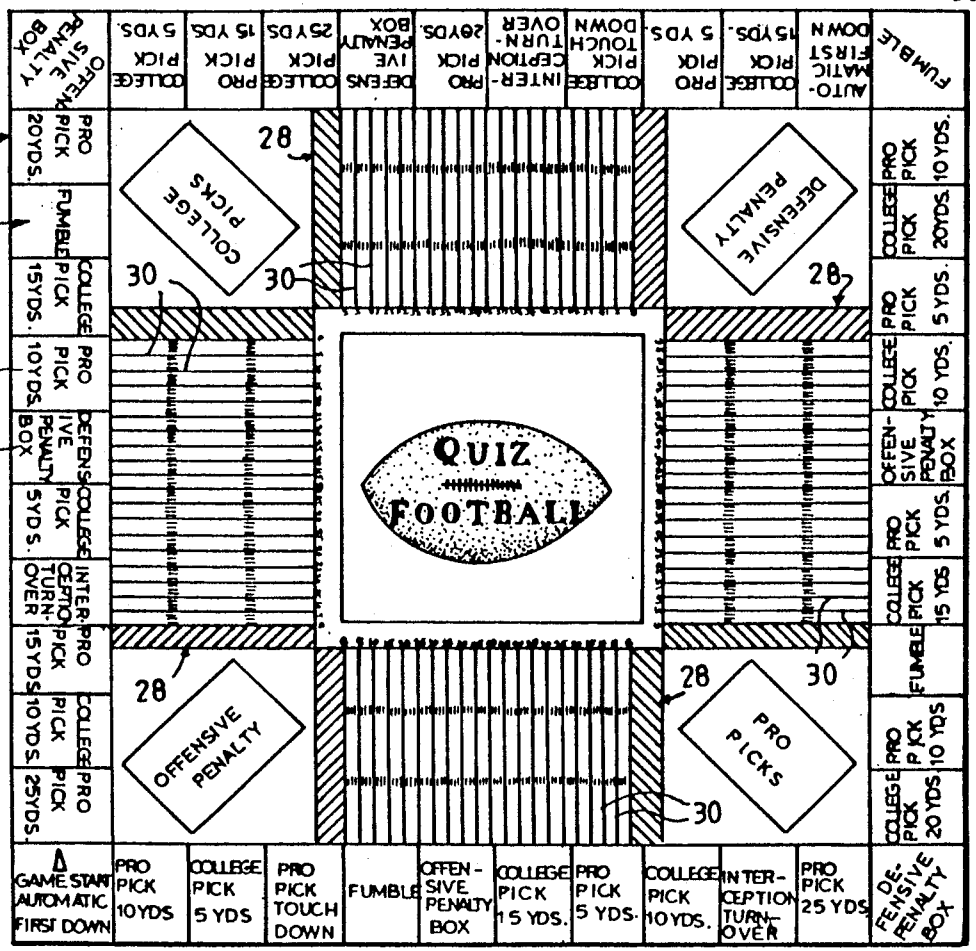
Fig. 2
Fig. 3
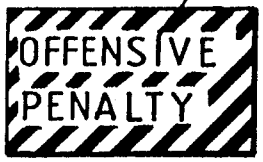
Fig. 4
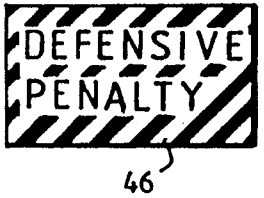

FIG. 7 ("LIVING HINGE" FOR OPTIONAL FOLDING GAMEBOARD)

FIG. 6 (OPTIONAL FOLDING GAMEBOARD)

QUIZ FOOTBALL BOARD GAME

BACKGROUND OF THE INVENTION

1. Field of the Invention

The instant invention relates generally to sporting event games and more specifically it relates to a quiz football board game.

2. Description of the Prior Art

Numerous sporting event games have been provided in prior art that are adapted to simulate sporting events and related subject matter, in which each player plays the game, builds up the team or bets on the scores of the game, such as football or the like. While these units may be suitable for the particular purpose to which they address, they would not be as suitable for the purposes of the present invention as heretofore described.

SUMMARY OF THE INVENTION

A primary object of the present invention is to provide a quiz football board game that will overcome the shortcomings of the prior art devices.

Another object is to provide a quiz football board game that is developed with the concept of having no strategy involved for each player in playing a simulated football game.

An additional object is to provide a quiz football board game in which a major portion of playing the simulated football game is answering correctly questions about football.

A further object is to provide a quiz football board game that is simple and easy to use.

A still further object is to provide a quiz football board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 2 is a top plan view of the game board.

FIG. 3 is a top plan view of one of the offensive penalty cards.

FIG. 4 is a top plan view of one of the defensive penalty cards.

FIG. 5 is a perspective view of one of the football shaped card boxes in greater detail.

FIG. 6 is a perspective view of a folding game board partly closed.

FIG. 7 is an enlarged perspective view as indicated by arrow 7 in FIG. 7 showing the living hinge in greater detail.

DETAILED DESCRIPTION OF THE PREFERRED EMBODIMENTS

Figure 1:
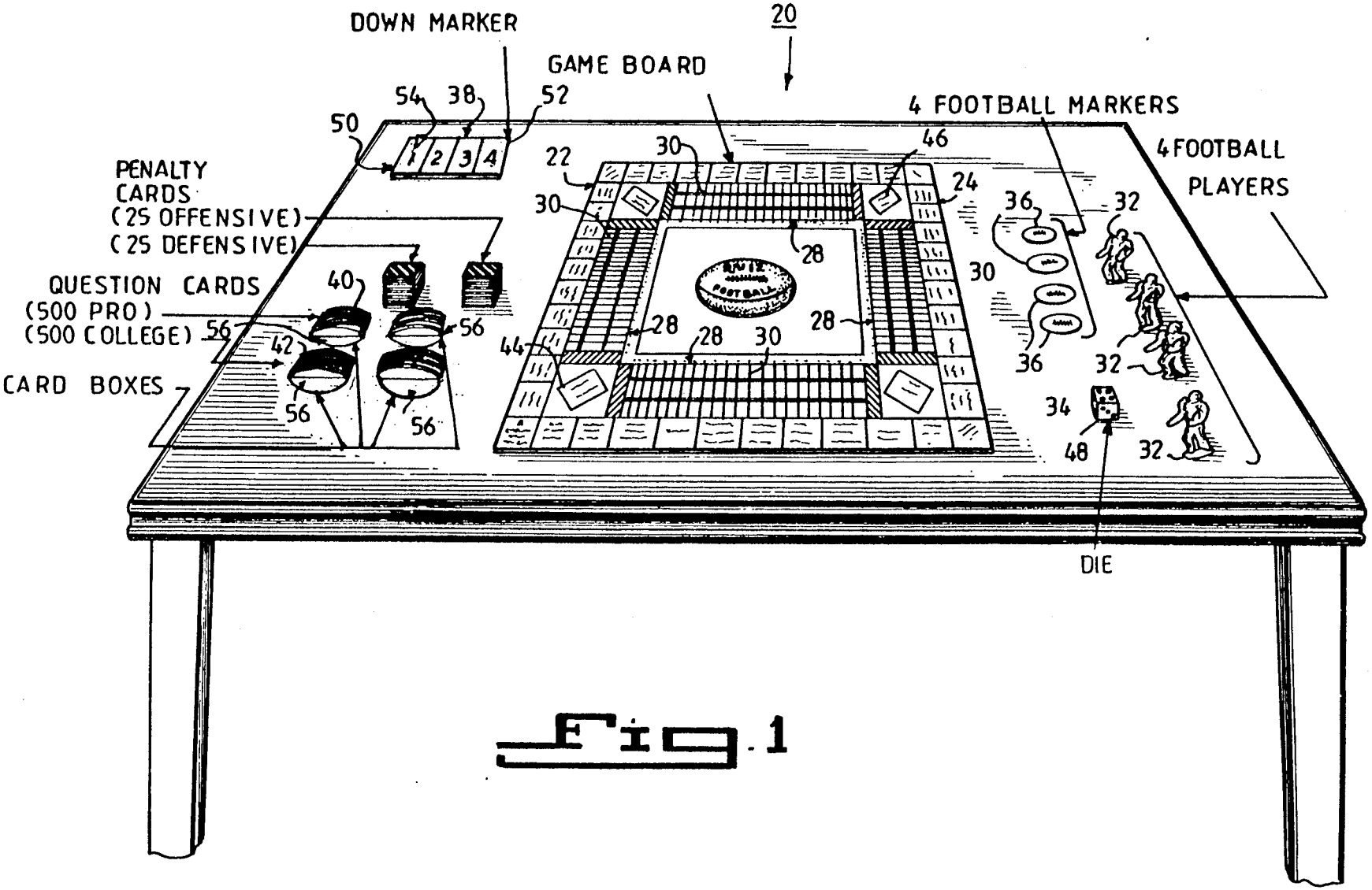
FIG. 1 is a perspective view of the instant invention placed upon a table.
Figures 8, 9, 10:
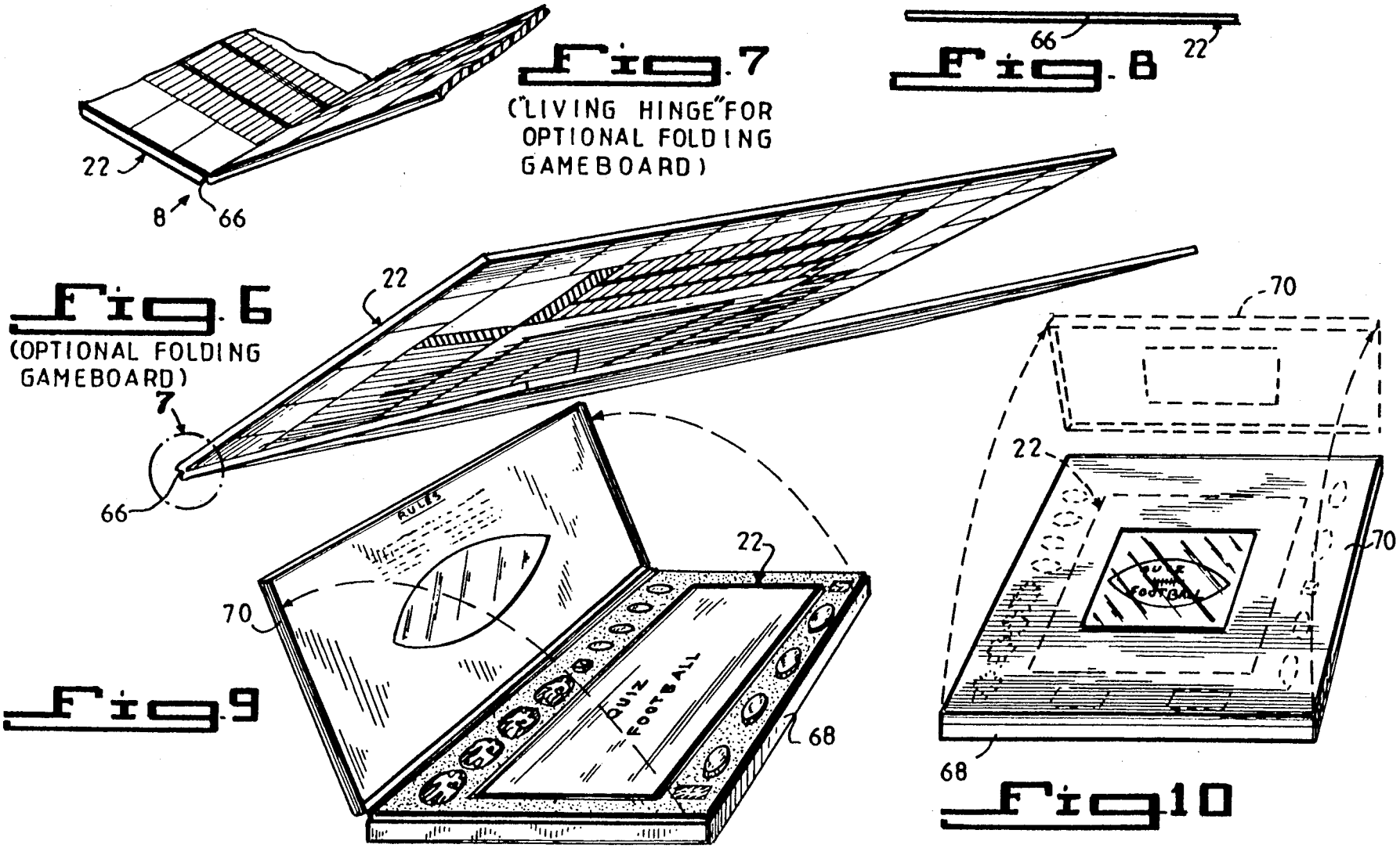
FIG. 8 is an end view taken in direction of arrow 8 in FIG. 7 showing the folding game board opened.
FIG. 9 is a perspective view of a storage box with the lid opened for the instant invention utilizing the folding game board.
FIG. 10 is a perspective view of another storage box with the lid closed for the instant invention utilizing the non-folding game board.

Turning now descriptively to the drawings, in which similar reference characters denote similar elements throughout the several views, the Figures illustrate a quiz football board game 20 which consists of a game board 22 having a continuous path 24 around its perimeter divided into consecutive playing spaces 26 bearing instructions representing various things to do during the play of the game 20 and a plurality of simulated football playing fields 28 with yardage markings 30 thereon. A playing piece 32 is for each of the game players with each playing piece 32 representing a football team and being of a size to fit within the playing spaces 26. A chance mechanism 34 is operable by the players in sequence for determining the number of playing spaces 26 to be traversed per turn by each playing piece 32. A football marker 36 is for indicating the position and advancement of a football along one of the simulated football playing fields 28. A down marker 38 is to indicate the correct down for each player. A plurality of professional football question and answer cards 40, a plurality of college football question and answer cards 42, a plurality of offensive penalty cards 44 and a plurality of defensive penalty cards 46 are also provided.

Each playing piece 22 of each respective player includes a respective configuration corresponding to a particular type of football player. The chance mechanism 34 is a die 48 having indicia on each face to indicate a number to correspond to the number of playing spaces 26 to be traversed by each playing piece 32. Each football marker 36 includes a respective configuration corresponding to a shape of a football and matched to one of the playing pieces 32.

The down marker 38 includes a rectangular base 50 divided into four down areas 52. An arrow pointer 54 moves upon the base 50 to indicate the correct down.

The quiz football board game 10 further includes a pair of card holders 56, in which one of the card holders 56 stores the professional football question and answer cards 40, while other of the card holders 56 stores the college football question and answer cards 42.

Each professional football question and answer card 40 includes a respective configuration corresponding to a shape and color of a football having its question on the upper half and its answer on the bottom half of the card. Each said college football question and answer card 42 includes a respective configuration corresponding to a shape and color of a football having its question on the upper half and its answer on the bottom half of the card.

Each card holder 56 includes a respective configuration corresponding to a shape of a football. One card holder 56 will receive the respective professional football question and answer cards 40 in a horizontally stacked relationship, while the other cards holder 56 will receive the respective college football question and answer cards 42 in a horizontally stacked relationship, allowing only the questions of each card 40, 42 to extend above. To read the answer each card 40, 42 must be removed from the respective card holder 56.

Each card holder 56 includes a housing 58 having a curved bottom 60 and a cover 62 having a curved top 64 so that when the cover 62 is placed upon the housing 58 the card holder 56 will be shaped in cross section as a football.

The game board 22 can further include a living hinge 66 thereacross, so as to divide the game board 22 into two halves so that the game board 22 can be folded over and stored when not in use.

The quiz football board game 10 further includes a storage box 68 for holding the various components therein, when not in use and a lid 70 for covering the storage box 68 to retain all of the various components within the storage box 68.

RULE FOR PLAYING THE GAME

1. Each player gets four downs (four rolls of the die 48) before turning the ball over to the next player, unless the player gets a first down or turns the ball over by landing on a playing spaces 26 or picks up a penalty card 44 or 46.
2. Each pro or college playing space 26 will indicate the amount of yardage the player will gain if a question is answered correctly.
3. There are two touchdown playing spaces 26 on the game board 22. If a question is answered correctly, that player gets seven points.
4. If a player lands a playing piece 32 in a fumble playing space 26, that player chooses a question of their choice. If the question is answered correctly, the player keeps the ball, however, it is counted as a down. If the question is answered incorrectly, the ball is turned over to the next player.
5. When a player lands on an interception playing space 26 the ball is automatically turned over to the next player.
6. When a player lands on an offensive or defensive penalty playing space 26, the player will pick up the respective card.
7. Each player will start on their own twenty yard line and go eighty yards for a touchdown (seven points).
8. If a player lands on a fumble playing space 26 on the fourth down, the ball is automatically turned over to the next player.
9. A touchdown equals seven points.
10. The first player to score four touchdowns wins, unless a time limit or other total is agreed upon by all players.
11. When a player scores a touchdown the next player gets the ball.
12. Each player has thirty seconds to answer a question.
13. Two to four players can play the game.

LIST OF REFERENCE NUMBERS

20: quiz football board game
22: game board
24: continuous path
26: playing space
28: simulated football playing field
30: yardage marking
32: playing piece
34: chance mechanism
36: football marker
38: down marker
40: professional football questions and answer card
42: college football question and answer card
44: offensive penalty card
46: defensive penalty card
48: die
50: rectangular base
52: down area on 50
54: arrow pointer
56: card holder
58: housing
60: curved bottom on 58
62: cover
64: curved top on 62
66: living hinge
68: storage box
70: lid on 68

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A quiz football board game which comprises:

a) a game board having a continuous path around its perimeter divided into consecutive playing spaces bearing instructions and a plurality of simulated football playing fields with yardage markings thereon;

b) a plurality of playing pieces one for each of the game players, each said playing piece representing a football team and being of a size to fit within the playing spaces;

c) a chance means operable by the players in sequence for determining the number of playing spaces to be traversed per turn by each said playing piece;

d) a plurality of football markers, each said football marker for indicating the position and advancement of a football along one of the simulated football playing fields;

e) a down marker to indicate the correct down for each player;

f) a plurality of professional football questions and answer cards;

g) a plurality of college football question and answer cards;

h) a plurality of offensive penalty cards; and i) a plurality of defensive penalty cards; and said plurality of playing spaced including question card selection spaces each having first indicia thereon corresponding to the selection of a question and answer card, said question card selection spaces each also having second indicia representing yardage distance corresponding to said yardage markings on said football fields.

2. A quiz football board game as recited in claim 1, wherein each said playing piece of each respective player includes a respective configuration corresponding to a particular type of football player.

3. A quiz football board game as recited in claim 2, wherein said chance means is a die having indicia on each face to indicate a number to correspond to the number of playing spaces to be traversed by each said playing piece.

4. A quiz football board game as recited in claim 3, wherein each said football marker includes a respective configuration corresponding to a shape of a football and matched to one of said playing pieces.

5. A quiz football board game as recited in claim 4, wherein said down marker includes:

a) a rectangular base divided into four down areas; and b) an arrow pointer which moves upon said base to indicate the correct down.

6. A quiz football board game as recited in claim 5, further including a pair of card holders, in which one of said card holders stores said professional football question and answer cards, while other of said card holders stores said college football question and answer cards.

7. A quiz football board game as recited in claim 6, wherein each said professional football question and answer card includes a respective configuration corresponding to a shape and color of a football having its question on the upper half and its answer on the bottom half of said card.

8. A quiz football board game as recited in claim 7, wherein each said college football question and answer card includes a respective configuration corresponding to a shape and color of a football having its question on the upper half and its answer on the bottom half of said card.

9. A quiz football board game as recited in claim 8, wherein each said card holder includes a respective configuration corresponding to a shape of a football so that one said card holder will receiver said respective professional football question and answer cards in a horizontally stacked relationship, while other said card holder will receive said respective college football question and answer cards in a horizontally stacked relationship, allowing only the questions of each card to extend above so that to read the answer, each card must be removed from said respective card holder.

10. A quiz football board game as recited in claim 9, wherein each said card holder includes:

a) a housing having a curved bottom; and b) a cover having a curved top so that when said cover is placed upon said housing said card holder will be shaped in cross section as a football.

11. A quiz football board game as recited in claim 10, wherein said game board further includes a living hinge thereacross so as to divide said game board into two halves so that said game board can be folded over and stored when not in use.

12. A quiz football board game as recited in claim 11, further including:

a) a storage box for holding the various components therein, when not in use; and b) a lid for covering said storage box to retain all of the various components within said storage box.

* * * * *